US010874174B2

(12) United States Patent
Qin

(10) Patent No.: US 10,874,174 B2
(45) Date of Patent: Dec. 29, 2020

(54) SHOE WITH SHOE EYELET STRUCTURE

(71) Applicant: DONGGUAN JIANGHAO PLASTIC PRODUCTS CO., LTD, Dongguan (CN)

(72) Inventor: Yetai Qin, Dongguan (CN)

(73) Assignee: DONGGUAN JIANGHAO PLASTIC PRODUCTS CO., LTD., Dongguan (CN)

( * ) Notice: Subject to any disclaimer, the term of this patent is extended or adjusted under 35 U.S.C. 154(b) by 16 days.

(21) Appl. No.: 16/320,682

(22) PCT Filed: Jan. 19, 2017

(86) PCT No.: PCT/CN2017/071685
§ 371 (c)(1),
(2) Date: Jan. 25, 2019

(87) PCT Pub. No.: WO2018/023957
PCT Pub. Date: Feb. 8, 2018

(65) Prior Publication Data

US 2019/0159551 A1 May 30, 2019

(30) Foreign Application Priority Data

Aug. 1, 2016 (CN) ..... 2016 1 0630531

(51) Int. Cl.
*A43C 5/00* (2006.01)
*A43B 23/02* (2006.01)
(Continued)

(52) U.S. Cl.
CPC ..... *A43C 5/00* (2013.01); *A41B 11/00* (2013.01); *A43B 1/14* (2013.01); *A43B 23/02* (2013.01);
(Continued)

(58) Field of Classification Search
CPC .. A43C 5/00; A43B 1/14; A43B 23/02; A43B 23/0215; A43B 23/0245; A43B 7/146
See application file for complete search history.

(56) References Cited

U.S. PATENT DOCUMENTS 4,841,647 A * 6/1989 Turucz ..... A43B 7/1415 36/43
7,774,884 B2 * 8/2010 Greene ..... A43B 9/00 12/142 V
(Continued)

FOREIGN PATENT DOCUMENTS

CN 202819807 U 3/2013
CN 202959009 U 6/2013
(Continued)

*Primary Examiner* — Ted Kavanaugh
(74) *Attorney, Agent, or Firm* — Shimokaji IP

(57) ABSTRACT

A shoe with a shoe eyelet structure includes a flexible substrate, a plastic protective layer formed outside the flexible substrate, and a shoe sole connected to the bottom of the flexible substrate. The flexible substrate is a braided fabric or a textile fabric of an integral structure. Several shoe eyelet structures are provided on an upper side between a shoe toe portion and a shoe throat portion of the flexible substrate. One end of the shoe eyelet structure is fixedly connected to the flexible substrate, and the shoe eyelet structure protrudes from the flexible substrate and is suspended so as to be penetrated by a shoe lace and adjust the degree of tightness of the flexible substrate. Such a shoe is comfortable and is easy to manufacture.

17 Claims, 6 Drawing Sheets

(51) Int. Cl.
*A41B 11/00* (2006.01)
*A43B 1/14* (2006.01)

(52) U.S. Cl.
CPC ..... *A43B 23/0215* (2013.01); *A43B 23/0245* (2013.01)

(56) References Cited

U.S. PATENT DOCUMENTS

| | | | | |
|---|---|---|---|---|
| 8,789,295 | B2 * | 7/2014 | Burch | B29D 35/146 36/45 |
| 9,078,488 | B1 * | 7/2015 | Meir | A43B 23/04 |
| 9,398,784 | B2 * | 7/2016 | Baudouin | A43B 7/12 |
| 9,474,331 | B2 * | 10/2016 | Waatti | A43B 1/02 |
| 9,888,743 | B2 * | 2/2018 | Bell | A43B 1/04 |
| 2006/0048413 | A1 * | 3/2006 | Sokolowski | B32B 27/12 36/45 |
| 2012/0199277 | A1 | 8/2012 | Loveder | |
| 2013/0260629 | A1 * | 10/2013 | Dua | A41D 27/245 442/189 |
| 2014/0020192 | A1 | 1/2014 | Jones et al. | |
| 2015/0013187 | A1 * | 1/2015 | Taniguchi | A43B 23/0255 36/84 |
| 2016/0219982 | A1 * | 8/2016 | Waatti | A43C 1/04 |
| 2019/0289960 | A1 * | 9/2019 | Loveder | B29D 35/02 |

FOREIGN PATENT DOCUMENTS

| | | | |
|---|---|---|---|
| CN | 105188441 | A | 12/2015 |
| WO | 2016126348 | A1 | 8/2016 |

* cited by examiner

SHOE WITH SHOE EYELET STRUCTURE

FIELD OF THE INVENTION

The present invention relates to shoes, and more particularly to shoes with shoe eyelet structures.

BACKGROUND OF THE INVENTION

In order to improve the wearing comfort of the shoes as much as possible, there is a shoe composed of a flexible substrate like a sock and a shoe sole provided at the bottom of the flexible substrate. The structure is similar to that of room socks, but the thick shoe sole can withstand a certain pressure of foot.

Although the flexible substrate made of textile materials can ensure the comfort, on one hand, the material of the flexible substrate is easily deformed, and the flexible substrate is loosened, which seriously affects the wearing lifetime of the shoes. On the other hand, these shoes are significantly different from ordinary shoes, which is not in line with the public aesthetic.

Therefore, there is a need to improve these shoes, so as to ensure basic property and the wearing comfort of the shoes, meanwhile to extend the lifetime and improve the appearance.

SUMMARY OF THE INVENTION

One objective of the present invention is to provide an improved shoe which has long lifetime and good appearance.

To achieve the above-mentioned objective, the present invention provides a shoe with shoe eyelet structure which includes:

a flexible substrate for cladding foot, which is an integrate structure made of braided fabric or textile fabric;

a plastic protective layer formed on an outer side of the flexible substrate;

a shoe sole connected to a bottom of the flexible substrate; and a plurality of shoe eyelet structures formed on an upper side between a shoe toe portion and a shoe throat portion of the flexible structure, one end of each shoe eyelet structure being fixed to the flexible substrate, and the shoe eyelet structures being protruded from the flexible substrate and suspended, thereby a shoe lace runs through the shoe eyelet structures so as to adjust the tightness of the flexible substrate.

In comparison with the prior art, the shoe with shoe eyelet structures according to the present invention provides the flexible substrate to wrap the foot, thus the shoe is comfortable; the plastic protective layer formed outside the flexible substrate can protect the foot on one hand, and prevent the flexible substrate from deformed on the other hand; the shoe eyelet structures formed between the shoe toe portion and the shoe throat portion allows the shoe lace to run through, so as to make the shoe artistic and meanwhile to adjust the tightness of the flexible substrate thereby extending the lifetime of the shoe. In conclusion, the shoe with the shoe eyelet structures added according to the present invention has long lifetime and good appearance, and the structure is simple and the manufacturing cost is low.

Preferably, the shoe eyelet structures are made of plastic materials, each shoe eyelet structure is partially adhered, bonded or molded on the outer side of the flexible substrate, and a part of the shoe eyelet structures with eyelets formed is separated from the flexible substrate.

As an embodiment, two rows of the shoe eyelet structures are opposite to one another and configured along a length direction of the shoe with spacing; an area of a part of the flexible substrate formed between the two rows of the shoe eyelet structures is not provided with the plastic protective layer. In such a configuration, the flexible substrate will be tightened without generating wrinkles when the shoe lace is tightened, so as to improve the wearing comfort.

As another embodiment, two shoe eyelet structures are opposite to one another and configured along a length direction of the shoe with spacing, and each shoe eyelet structure is provided with a plurality of eyelets; an area of a part of the flexible substrate formed between the two shoe eyelet structures is not provided with the plastic protective layer.

Specifically, the shoe eyelet structures and the plastic protective layer are formed in an integrate structure. In such a way, the structure and the producing process are simplified.

As another embodiment, the plastic protective layer includes a plurality of plastic protective pieces which are independent from one another and molded on the flexible substrate in a certain order. In such a way, the flexible substrate is not fully covered by the plastic protective layer, thus the shoe has good breathability.

Preferably, the plastic protective pieces are staggered along a texture direction of the flexible substrate. Therefore, the deformation of the flexible substrate is reduced to extend the lifetime of the shoe.

As another embodiment, the plastic protective layer comprises meshy parts fixed to the outer side of the flexible substrate.

Preferably, the plastic protective layer further comprises an enhanced plastic stripe formed at a side of the meshy parts.

Preferably, the plastic protective layer is adhered, bonded or molded on the outer side of the flexible substrate. Therefore, the plastic protective layer and the flexible substrate are formed in a close structure to reduce the deformations of the flexible substrate thereby extending the lifetime of the shoe.

Preferably, the shoe further includes a PU massaging member molded on an inner side of the flexible substrate and opposite to a position of foot sole. The connection between the PU massaging members and the flexible substrate is steady, which prevents the PU massaging members from peeling off. Additionally, the PU material has the desirable resilience and softness to provide comfortable feelings to the foot sole, and meanwhile provides sufficient massage force and will not be worn easily.

As an embodiment, the PU massaging members are the bulges in the shapes of truncated cones, curved-surface shapes, hemispherical shapes, and/or conical shapes.

As another embodiment, the PU massaging member comprises a connecting layer connected to the inner side of the flexible substrate, and a plurality of PU bulges configured at a side, which is opposite to the flexible substrate, of the connecting layer. The connecting layer and the PU bulges are in integrate structure, and the whole of the connecting layer is located at the inner side of the flexible substrate, thus the connection between the PU massaging members is steady.

Specifically, the PU bulges are arranged with spacing. Preferably, the PU bulges are arranged along foot points so that the foot can be massaged by the PU bulges.

Preferably, the height of the portion, which is opposite to the foot arch portion, of the PU massaging member is larger than the height of other portions of the PU massaging member. In such a way, the higher foot arch portion still can be massaged.

Preferably, the height of the portion, which is located at the junction of the toe and the foot sole, of the PU massaging member is lower than the height of the other portions of the PU massaging member. In such a way, the junction of the toe and the foot sole is prevented from enduring excessive pressure, thereby obtaining a comfortable feeling.

Preferably, a side of the flexible substrate is provided with the shoe throat portion, the rest of flexible substrate is a continuous structure; the shoe sole is molded on a bottom side of the flexible substrate, and a part of flexible substrate that is connected with the shoe sole forms an insole portion. When users put on the shoes, the flexible substrate made of flexible material is deformed as the foot motions, thus the foot will not have constraint feeling, and the foot can freely move, thereby improving the wearing experience for the users.

Preferably, a side, which is protruded towards the flexible substrate, of the shoe sole is provided with a foot arch support portion.

Preferably, a side, which is opposite to the flexible substrate, of the shoe sole is flat.

Preferably, a side, which is opposite to the flexible substrate, of the sole is provided with antiskid patterns. In such a way, the friction between the shoe sole and the ground is increased to prevent user from slipping.

Preferably, a side, which is opposite to the flexible substrate, of the shoe sole is provided with a shoe tube portion; a side, which is opposite to the shoe sole, of the shoe tube portion is provided with the shoe throat portion; and the shoe tube portion is adapted for cladding ankles or shank. In such a way, the shoe tube portion can protect the ankles from the cold and match with the trousers to improve the comfort.

BRIEF DESCRIPTION OF THE DRAWINGS

FIG. 2 is a schematic view of the shoe with shoe eyelet structure with a shoe lace running through;

DETAILED DESCRIPTION OF ILLUSTRATED EMBODIMENTS

A distinct and full description of the technical solution of the present invention will follow by combining with the accompanying drawings.

Figure 1:
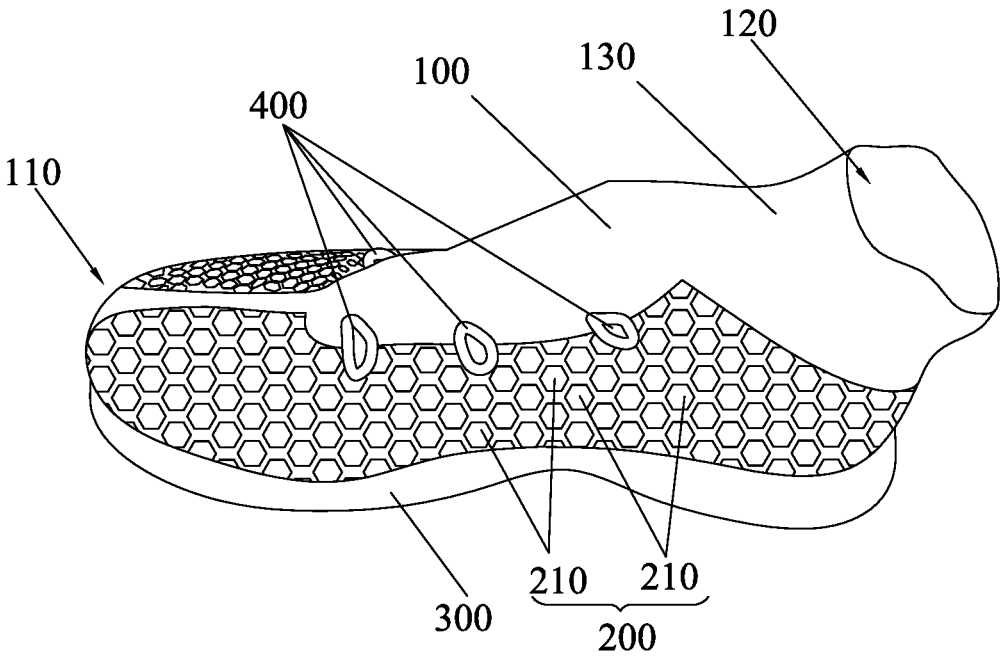
FIG. 1 is a schematic view of a shoe with shoe eyelet structure according to one embodiment of the present invention.

Referring to FIG. 1, a shoe with shoe eyelet structure according to the present invention includes a flexible substrate 100 for wrapping the foot, a plastic protective layer 200 formed outside the flexible substrate 100, and a shoe sole 300 connected to a bottom of the flexible substrate 100. A plurality of shoe eyelet structures 400 are formed on an upper side between a shoe toe portion 110 and a shoe throat portion 120 of the flexible substrate 100, one end of each shoe eyelet structure 400 is fixed to the flexible substrate 100, and the shoe eyelet structures are protruded from the flexible substrate 100 and suspended, thereby a shoe lace 500 can pass through the shoe eyelet structures 400 so as to adjust the tightness of the flexible substrate 100.

Referring to FIGS. 2-5, the flexible substrate 100 is an integrate structure and made of a braided fabric or a textile fabric, such as cotton or chemical fiber. In such a way, the flexible substrate with better elasticity can clad the feet and provide better comfort. For understanding, the flexible substrate 100 is constructed similarly to a sock.

Figure 2:
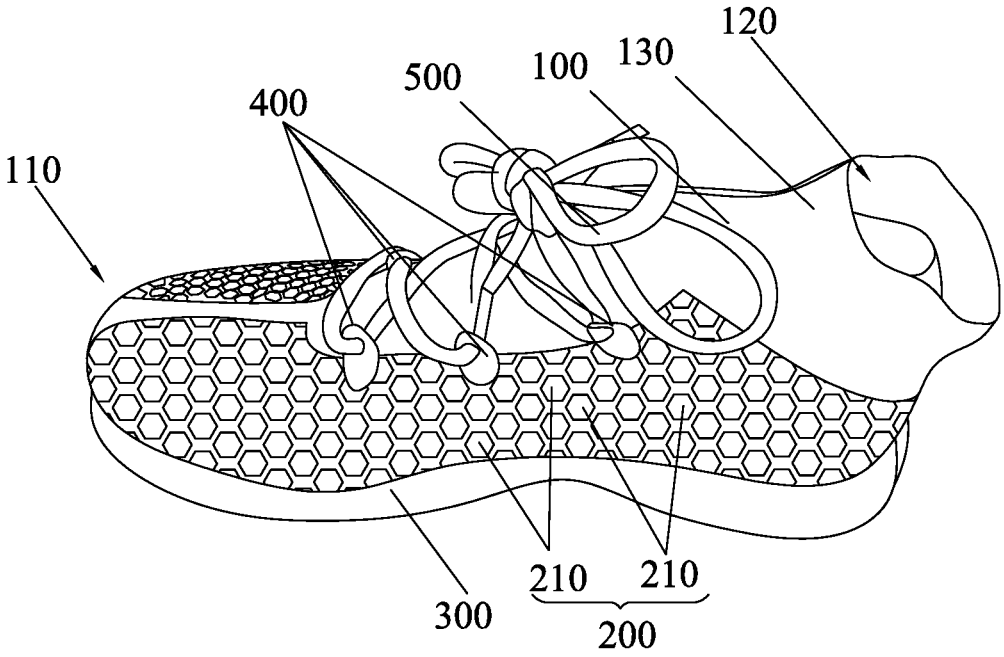

Further, as shown in FIG. 2, the flexible substrate 100 is a continuous structure and provides a shoe throat portion 120 as the only opening for receiving the foot. A shoe sole 300 is molded on the bottom side of the flexible substrate 100, and a part of flexible substrate 100 that is connected with the shoe sole forms an insole portion. When users put on the shoes, the flexible substrate made of flexible material is deformed as the foot motions, thus the foot will not have constraint feeling, and the foot can freely move, thereby improving the wearing experience for the users.

In a first embodiment, as illustrated in FIGS. 1 and 2, the shoe sole 300 is molded on the bottom side of the flexible substrate 100, and a part of flexible substrate 100 that is connected with the shoe sole forms the insole portion. Specifically, the shoe sole 300 is made of plastic materials; in details, the plastic materials are melted to the flexible substrate 100 where is opposite to the foot sole, and then cured. By this token, the connection between the shoe sole 300 and the flexible substrate 100 is quite steady. After wearing the shoe, the foot is wrapped by the flexible substrate 100, and the shoe sole 300 is for contacting with the ground. Additionally, the insole portion formed between the shoe sole 300 and the foot can supply buffer and protection for the foot. Preferably, the insole portion is made of cotton, woolen yarn or chemical fiber, thus the breathability is good, thereby preventing the user from feeling stuffiness when wearing the shoe, and reducing the possibility of beriberi attack.

Preferably, a side, which is protruded towards the flexible substrate 100, of the shoe sole 300 is provided with a foot arch support portion. Due to the foot arch support portion, a support is supplied to the foot arch so as to further improve the comfort. It should be noted that, the foot arch support portion is configured at the position where is opposite to the foot arch of user.

Referring to FIG. 2 again, a side, which is opposite to the flexible substrate 100, of the shoe sole 300 is flat. In such a way, contact area between the foot sole 300 and the ground is increased, so as to increase friction therebetween. But it should be understood, the shoe sole 300 is not flat absolutely, the shoe toe position of the shoe sole can tilt upwards slightly, in order to make the structure of the shoe sole 300 ergonomic, thereby improving the wearing comfort.

Figure 5:
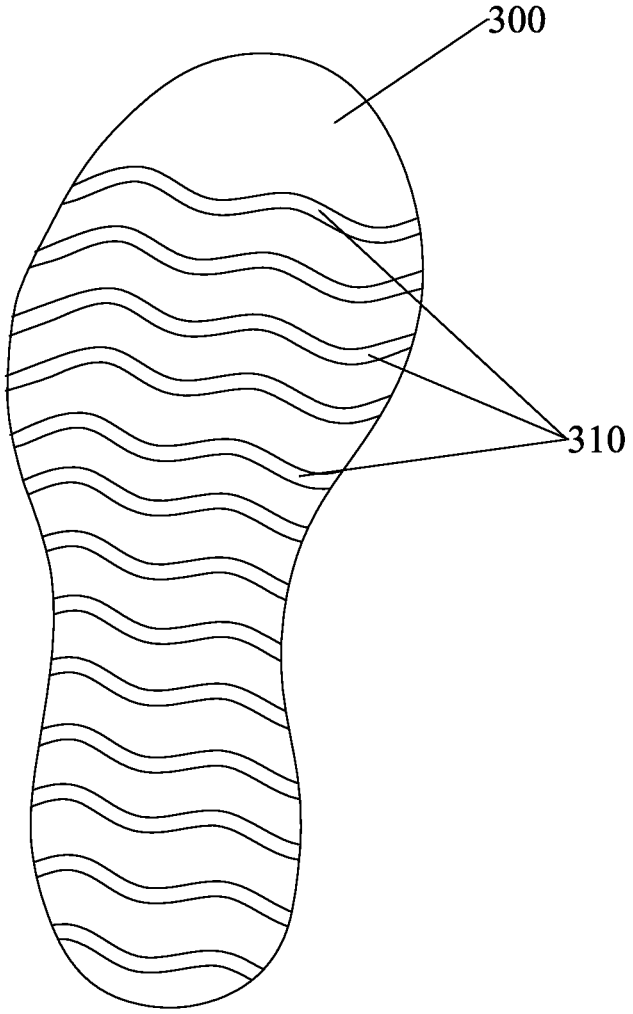
FIG. 5 is a schematic view of a sole of the shoe with shoe eyelet structure.

Preferably, for improving the friction between the shoe sole 300 and the ground, as shown in FIG. 5, a side, which is opposite to the flexible substrate 100, of the shoe sole 300 is provided with antiskid patterns 310. In this embodiment, the antiskid patterns 310 are in wave shapes, which are not limited however. Optionally, the antiskid patterns 310 can have other shapes or patterns.

Referring to FIG. 1 again, preferably, a side, which is opposite to the flexible substrate 100, of the shoe sole 300 is provided with a shoe tube portion 130; a side, which is opposite to the shoe sole 300, of the shoe tube portion 130 is provided with the shoe throat portion 120; and the shoe tube portion 130 is adapted for cladding ankles or shank. In such a way, the shoe tube portion 130 can protect the ankles from the cold and match with the trousers to improve the comfort.

Since the present shoe includes the flexible substrate 100 and the shoe sole 300, thus users feel comfortable like putting on a sock, when he puts on the shoe. However, due to the material limitation of the flexible substrate 100, the shoe is easy to deform to reduce the lifetime of the shoe.

In view of this, the shoe provides a plastic protective layer 200 formed on an outer side of the flexible substrate 100, so as to extend the lifetime of the shoes and protect the foot of the user, meanwhile protect the flexible substrate 100 from becoming dirty fast. Specifically, the plastic protective layer 200 can be adhered, bonded or molded on the outer side of the flexible substrate 100, so that the plastic protective layer 200 and the flexible substrate 100 are formed together closely, thereby reducing the deformation of the flexible substrate 100. After the shoe is taken off, the plastic protective layer 200 is restored to the initial status quickly, thereby extending the lifetime of the shoe. Note, the plastic protective layer 200 is only formed on the upper side of the flexible substrate 100 where is configured without shoe sole 300.

In this embodiment, the plastic protective layer 200 includes a plurality of plastic protective pieces 210 which are independent from one another with certain spacing and molded on the flexible substrate 100 according a certain order manner. In such a way, the flexible substrate 100 is not fully covered by the plastic protective layer 200, so that the breathability of the shoe is good.

Preferably, the plastic protective pieces 210 are staggered along a texture direction of the flexible substrate 100, in such a way, on one hand, the certain gaps are kept; on the other hand, the deformation of the flexible substrate 100 is reduced to extend the lifetime. In this embodiment, the texture of the flexible substrate 100 is extended towards the shoe throat portion 120, which is not illustrated in the FIGS. 1 and 2. Since the plastic protective pieces 210 are staggered on the flexible substrate 100, that is, any texture of the flexible substrate 100 is covered with different plastic protective pieces 210 along the texture direction, thus the flexible substrate 100 is hard to deform.

In one embodiment, the plastic protective pieces 210 are regular hexagonal, optionally, can be square, rectangle, or rounded.

With contemplation of the present invention, a plurality of shoe eyelet structures 400 is formed on an upper side between the shoe toe portion 110 and the shoe throat portion 120 of the flexible structure 100. Specifically, one end of each shoe eyelet structure 400 is fixed to the flexible substrate 100, and the shoe eyelet structures 400 are protruded from the flexible substrate 100 and suspended, thereby the shoe lace 500 passes through the shoe eyelet structures 400 so as to adjust the tightness of the flexible substrate 100. More specifically, a part of the shoe eyelet structure 400 is adhered, bonded or molded on the outer side of the flexible substrate 100, and another part of the shoe eyelet structure 400 with eyelets is separated from the flexible substrate 100. The shoe eyelet structures 400 located between the shoe toe portion 110 and the shoe throat portion 120 can allow the shoe lace 500 to pass through, thus the shoe is artistic; and on the other hand, the tightness of the flexible substrate 100 can be adjusted to fit the user.

In this embodiment, as shown in FIGS. 1 and 2, two rows of the shoe eyelet structures 400 are opposite to one another and configured along a length direction of the shoe, and no plastic protective layer 200 is formed on the part of the flexible substrate 100 where is located between the two rows of the shoe eyelet structures 400. Moreover, the part of the flexible substrate 100 located between the two rows of the shoe eyelet structures 400 is also continuous. Thus, when the shoe lace 500 is tight to tighten the flexible substrate 100, it's easy to achieve the tightening without generating wrinkles on the flexible substrate 100, thereby improving the wearing comfort.

Figure 3:
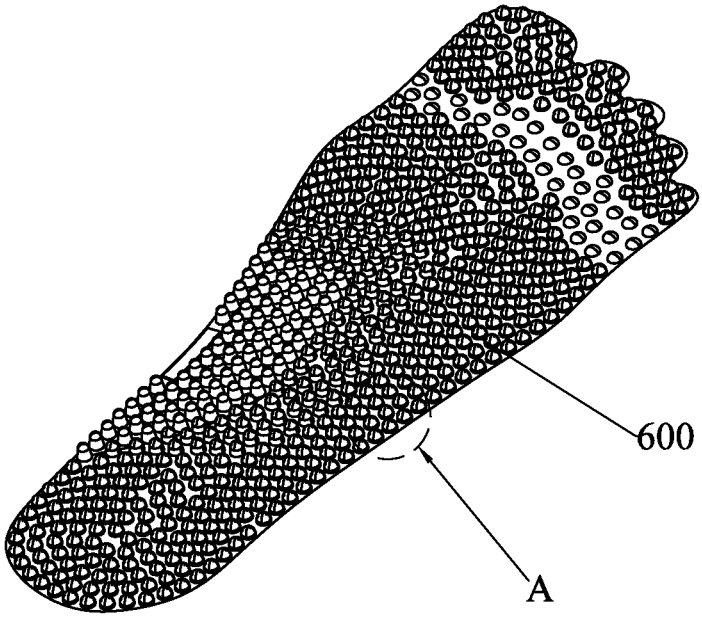
FIG. 3 is a schematic view of a flexible substrate where is opposite to the foot sole.

Preferably, as shown in FIG. 3, the shoe with shoe eyelet structure according the present invention further includes a PU massaging member 600 molded on an inner side of the flexible substrate 100 and opposite to a position of foot sole. Specifically, combining with FIG. 4, PU materials are molded on the inner side of the flexible substrate 100 to form several PU massaging members 600 with spacing, preferably, the PU massaging members 600 are arranged along foot points so that the foot can be massaged by the PU massaging members 600. Of course, other arrangements for the PU massaging members 600 can be chosen, which is not limited here.

After user puts on the shoes according to the present invention, the PU massaging members 600 contact with and press the foot sole, when the user walls; in such a way, massage effect to the foot sole is achieved, with the protruded PU massaging members 600. The connection between the PU massaging members 600 and the flexible substrate 100 is steady, which prevents the PU massaging members 600 from peeling off. Additionally, the PU material has the desirable resilience and softness to provide comfortable feelings to the foot sole, and meanwhile provides sufficient massage force and will not be worn easily.

Figure 4:
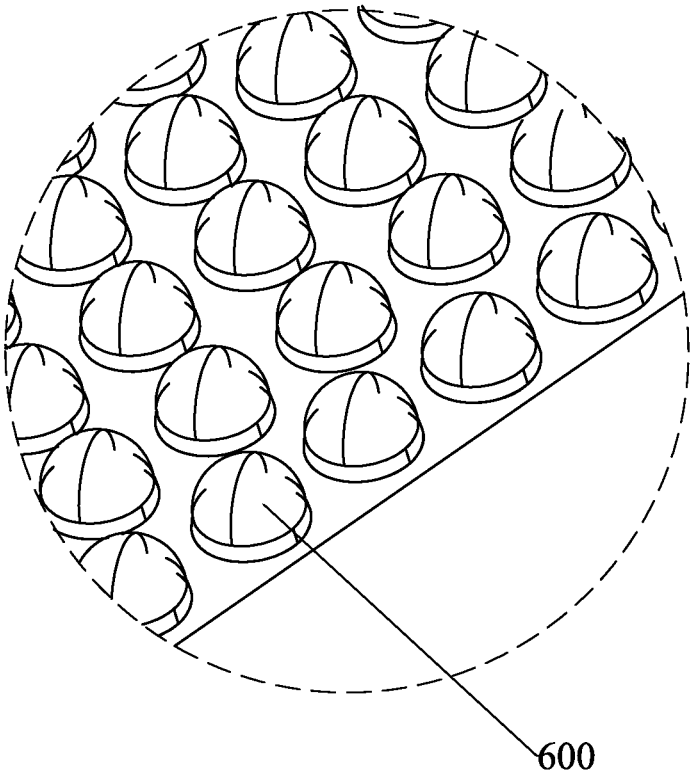
FIG. 4 is an enlarged view of the A portion shown in FIG. 3.

Preferably, the PU massaging members 600 are the bulges in the shapes of truncated cones, curved-surface shapes, hemispherical shapes, and/or conical shapes. Of course, the PU massaging members 600 can also be other shapes, as long as it protrudes from the foot sole side of the flexible substrate 100, and can achieve the massage effect when the user wears the shoe. In the present embodiment, as shown in FIG. 4, one side, which is close to the flexible substrate 100, of the PU massaging member 600 is in a truncated cone shape, another side, which is far away from the flexible substrate 100, of the PU massaging member 600 is in a curved-surface shape.

For achieving the better massaging effect, the height of the portion, which is opposite to the foot arch portion, of the PU massaging member 600 is larger than the height of other portions of the PU massaging member 600. In such a way, the higher foot arch portion still can be massaged.

Preferably, the height of the portion, which is located at the junction of the toe and the foot sole, of the PU massaging member 600 is lower than the height of the other portions of the PU massaging member 600. In such a way, the junction of the toe and the foot sole is prevented from enduring excessive pressure, thereby obtaining a comfortable feeling.

Differing from the above embodiment, a connecting layer is connected to the inner side of the flexible substrate 100 in this embodiment. Specifically, the PU massaging member 600 includes a connecting layer connected to the inner side of the flexible substrate 100, and a plurality of PU bulges configured at a side of the connecting layer where is opposite to the flexible substrate 100. The connecting layer and the PU bulges are in integrate structure, and the whole of the connecting layer is located at the inner side of the flexible substrate 100, thus the connection between the PU massaging members 600 is steady.

Similarly, in this embodiment, the PU massaging members 600 are the bulges in the shapes of truncated cones, curved-surface shapes, hemispherical shapes, and/or conical shapes. Of course, the PU massaging members 600 can also be other shapes, as long as it protrudes from the foot sole side of the flexible substrate 100, and can achieve the massage effect when the user wears the shoe. In the present embodiment, as shown in FIG. 4, one side, which is close to the flexible substrate 100, of the PU massaging member 600 is in a truncated cone shape, another side, which is far away from the flexible substrate 100, of the PU massaging member 600 is in a curved-surface shape.

Figure 6:
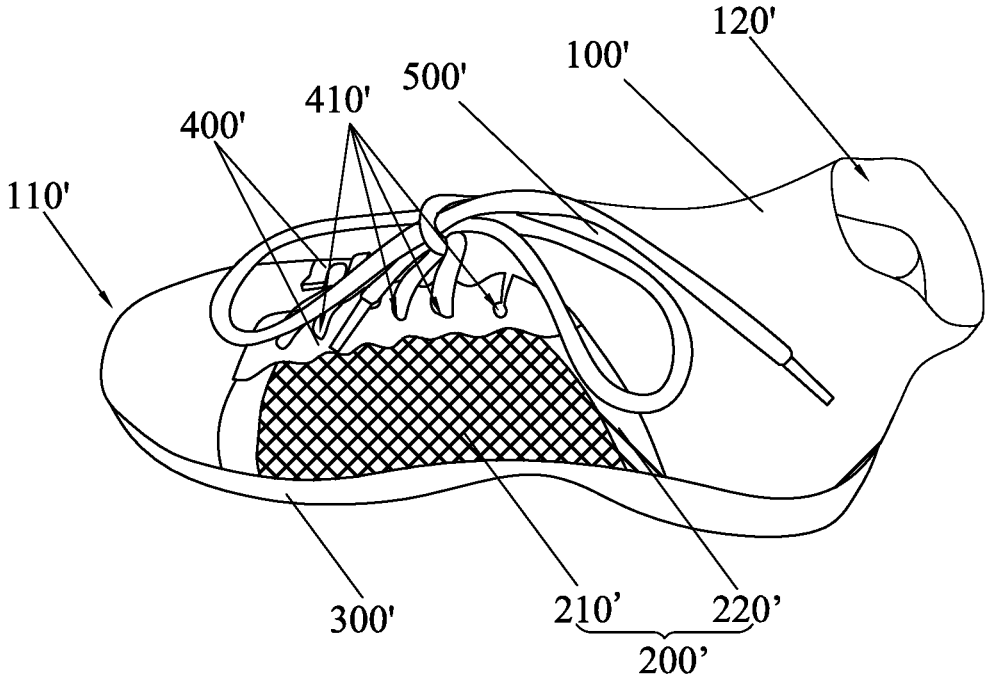
FIG. 6 is a schematic view of a shoe with shoe eyelet structure according to one embodiment of the present invention.

FIG. 6 shows a schematic view of the shoe according to another embodiment of the present invention.

As shown, the differences between this embodiment and the first embodiment include:

First, the plastic protective layer 200' includes meshy parts 210' fixed to the outer side of the flexible substrate 100' and an enhanced plastic stripe 220' formed at a side of the meshy parts 210'. Specifically, the meshy parts 210' are the continuous structures to reduce the deformation of the flexible substrate 100' and maintain the good breathability. The enhanced plastic stripe 220' and the meshy parts 210' are formed in an integrate structure, preferably, in order to protect the meshy parts 210'.

Second, two shoe eyelet structures 400' are configured oppositely to one another and configured along the length direction of the shoe with spacing, and the shoe eyelet structures 400' are provided with several eyelets. The area of the partial flexible substrate 100' formed between the two shoe eyelet structures 400' is not provided with the plastic protective layer 200'. Compared with the first embodiment, the difference is that, the shoe eyelet structures 400' are formed in an integrate structure. The functions of the shoe eyelet structures 400' are the same with the above embodiments.

Furthermore, the shoe eyelet structures 400' and the plastic protective layer 200' are formed in an integrate structure, both of the shoe eyelet structures 400' and the plastic protective layer 200' are made of plastic materials, thus the making procedure.

In comparison with the prior art, the shoe with shoe eyelet structures according to the present invention provides the flexible substrate 100 to wrap the foot, thus the shoe is comfortable; the plastic protective layer 200 formed outside the flexible substrate 100 can protect the foot on one hand, and prevent the flexible substrate 100 from deformed on the other hand; the shoe eyelet structures 400 formed between the shoe toe portion 110 and the shoe throat portion 120 allows the shoe lace 500 to run through, so as to make the shoe artistic and meanwhile to adjust the tightness of the flexible substrate 100 thereby extending the lifetime of the shoe. In conclusion, the shoe with the shoe eyelet structures added according to the present invention has long lifetime and good appearance.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A shoe with shoe eyelet structure, comprising:

a flexible substrate for cladding foot, which has a sock like shape that is an integrate structure made of braided fabric;

a plastic protective layer formed on an outer side of the flexible substrate;

a shoe sole connected to a bottom of the flexible substrate; and a plurality of shoe eyelet structures formed on an upper side between a shoe toe portion and a shoe throat portion of the flexible structure, one end of each shoe eyelet structure being fixed to the flexible substrate, and the shoe eyelet structures being protruded from the flexible substrate and suspended, thereby a shoe lace runs through the shoe eyelet structures so as to adjust the tightness of the flexible substrate; and the shoe eyelet structures are made of plastic materials and molded on the outer side of the flexible substrate in an integrate structure.

2. The shoe with shoe eyelet structure according to claim 1, wherein two rows of the shoe eyelet structures are opposite to one another and configured along a length direction of the shoe with spacing; an area of a part of the flexible substrate formed between the two rows of the shoe eyelet structures is not provided with the plastic protective layer.

3. The shoe with shoe eyelet structure according to claim 2, wherein the shoe eyelet structures and the plastic protective layer are formed in an integrate structure.

4. The shoe with shoe eyelet structure according to claim 1, wherein two shoe eyelet structures are opposite to one another and configured along a length direction of the shoe with spacing, and each shoe eyelet structure is provided with a plurality of eyelets; an area of a part of the flexible substrate formed between the two shoe eyelet structures is not provided with the plastic protective layer.

5. The shoe with shoe eyelet structure according to claim 1, wherein the plastic protective layer includes a plurality of plastic protective pieces which are molded on the flexible substrate and spaced with one another.

6. The shoe with shoe eyelet structure according to claim 5, wherein the plastic protective pieces are staggered along a direction of the flexible substrate.

7. The shoe with shoe eyelet structure according to claim 5, wherein the plastic protective layer is adhered, bonded or molded on the outer side of the flexible substrate.

8. The shoe with shoe eyelet structure according to claim 1, wherein the plastic protective layer comprises meshy parts fixed to the outer side of the flexible substrate.

9. The shoe with shoe eyelet structure according to claim 8, wherein the plastic protective layer further comprises an enhanced plastic stripe formed at a side of the meshy parts.

10. The shoe with shoe eyelet structure according to claim 1, further comprising a polyurethane massaging member molded on an inner bottom side of the flexible substrate.

11. The shoe with shoe eyelet structure according to claim 10, wherein the polyurethane massaging member comprises a connecting layer connected to the inner side of the flexible substrate, and a plurality of polyurethane bulges configured at a side, which is opposite to the flexible substrate, of the connecting layer.

12. The shoe with shoe eyelet structure according to claim 11, wherein the polyurethane bulges are arranged with spacing.

13. The shoe with shoe eyelet structure according to claim 1, wherein a side of the flexible substrate is provided with the shoe throat portion, the rest of flexible substrate is a continuous structure; and the shoe sole is molded on an outer bottom side of the flexible substrate, and an insole portion is provided on the flexible substrate and is connected with the shoe sole.

14. The shoe with shoe eyelet structure according to claim 13, wherein a foot arch support portion is provided on a side of the shoe sole and is protruded towards the flexible substrate.

15. The shoe with shoe eyelet structure according to claim 14, wherein a outer bottom side of the shoe sole is flat.

16. The shoe with shoe eyelet structure according to claim 13, wherein a outer bottom side of the sole is provided with antiskid patterns.

17. The shoe with shoe eyelet structure according to claim 13, wherein a side of the shoe sole is provided with a shoe tube portion; a side of the shoe tube portion is provided with the shoe throat portion.

* * * * *